United States Patent [19]

Russell et al.

[11] Patent Number: 4,812,140

[45] Date of Patent: Mar. 14, 1989

[54] CONTINUOUS AQUEOUS DYEING PROCESS FOR HIGH-TENACITY INDUSTRIAL NYLON FABRICS

[75] Inventors: Ernest J. Russell, Greensboro; M. K. Choi, Jamestown, both of N.C.

[73] Assignee: Burlington Industries, Inc., Greensboro, N.C.

[21] Appl. No.: 73,481

[22] Filed: Jul. 15, 1987

[51] Int. Cl.[4] ..... D06P 5/00

[52] U.S. Cl. ..... 8/492; 8/444; 8/476; 8/493; 8/680; 8/924; 8/130.1

[58] Field of Search ..... 8/476, 492, 680, 493

[56] References Cited

U.S. PATENT DOCUMENTS 3,433,008 3/1969 Gage ..... 264/130

*Primary Examiner*—A. Lionel Clingman

*Attorney, Agent, or Firm*—Nixon & Vanderhye

[57] ABSTRACT

High-tenacity nylon fabrics are dyed in a multi-step continuous aqueous dyeing process. Uniformly dyed fabrics having a high degree of fiber bundle penetration result.

14 Claims, 1 Drawing Sheet

CONTINUOUS AQUEOUS DYEING PROCESS FOR HIGH-TENACITY INDUSTRIAL NYLON FABRICS

High-tenacity nylon fabrics are dyed in a multi-step continuous aqueous dyeing process. Uniformly dyed fabrics having a high degree of fiber bundle penetration result.

BACKGROUND OF THE INVENTION

High-tenacity nylon fabrics have been difficult to dye uniformly using conventional dyeing procedures. Due to the unusually high orientation of the fiber crystallites, high denier per filament, subsequent texturizing (in some cases), and other factors, dye penetration with any degree of uniformity in these high-tenacity nylon fabrics has only been achieved through very long batch operations. Typical batch operations, such as a jig or pad roll, often produce a striated appearance with poor shade uniformity from roll-to-roll. The heavier denier, high-tenacity fabrics are also subject to moire effects or poor selvage shading.

The process of this invention, which may be conducted on a continuous dyeing range, employs a dye assistant system to effectively and uniformly dye industrial high-tenacity nylon fabrics such as Cordura®, nylon antiballistic fabrics, and others as further identified below. The continuous process uses an aqueous-based, homogeneous system and produces uniform, non-striated, high-tenacity dyed nylon with exceptional fiber bundle penetration. THe process is more economical than conventional batch dyeing operations and uses commercially available range equipment. The process is continuous and the dyed fabric is of a more uniform quality, including a non-striated appearance with well-penetrated yarn bundles, from end to end and piece to piece as compared with fabrics dyed using the conventional batch procedure.

As used in this disclosure, the term high-tenacity nylon refers to fibers of a high tensile strength nylon yarn spun from poly(hexamethyleneadipamide), or 6,6 nylon, which has a draw ratio of at least 4.0, and preferably in the range of 4.6 to 5.1. Such fibers are disclosed in U.S. Pat. No. 3,433,008 to Gage, and are currently commercially available from various sources including Cordura® from DuPont, Wilmington, Del. These fibers are used to make fabrics which are in turn formed into long-wearing, abrasion-resistant articles of clothing, suitcase and handbag material, antiballistic clothing and protective devices and similar articles.

The currently preferred Cordura® product contains approximately twice as many amino end-groups as conventional nylon. The presence of these end-groups favors undesirable ring dyeing of the fabric, and makes uniform dyeing and complete penetration of the yarn bundle difficult in a continuous process. Ballistic nylons and other high-tenacity nylon products may not contain an unusually high content of amine end-groups as does Cordura®, but they are also easily dyed by the process of this invention.

It is believed that the essential difference between generic 6,6 nylon and the high-tenacity nylons of concern to the present invention lies in the higher degree of structural order of these stronger nylons. The higher degree of structural order allows a wider latitude in processing operations and conditions, beyond limits that would normally be tolerated by conventional nylon fabrics. As an example, high-tenacity nylon with its higher degree of order is amenable to drastic steaming at elevated temperatures with little loss of strength.

DETAILED DESCRIPTION OF THE INVENTION

Figure 1:
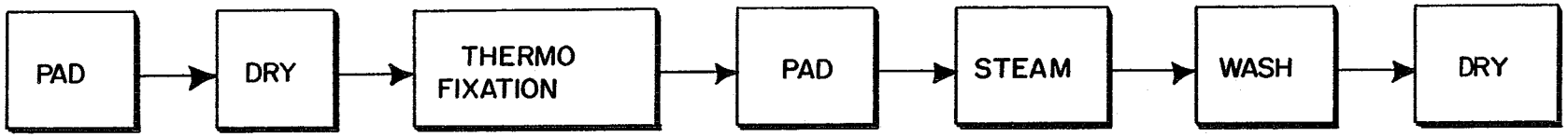
FIG. 1 is a flow chart illustrating the operative procedures of a preferred embodiment of the invention as described in more detail below.

Described is a process for uniformly continuously dyeing high-tenacity industrial nylon fabrics made of high tensile strength nylon 6,6 yarn having a draw ratio of at least 4.0. An aqueous dyebath containing a tinctorial amount of an acid dyestuff and a dye transport system active at elevated temperatures is applied to the fabric in open width. The dye transport system is composed of a retarding and leveling agent volatile at elevated temperatures to facilitate rapid penetration of the nylon filament bundles and mono-, di-, tri- or other ($C_1$–$C_4$) alkylene glycols having a molecular weight in the range of about 50 to about 200. The dyed fabric is preliminarily dried to reduce migration of the dyebath liquid on the fiber, to heat activate the dye transport system and promote uniform penetration of the filament bundle. The dried fabric is thermofixed at elevated temperatures—this causes the dyestuff to penetrate into the fibers and to volatilize the retarding and leveling agent. Dye penetration is enhanced by exposing the fabric to a wetting agent and a nylon swelling agent to swell the nylon fibers and further penetrate the dyestuff into the nylon fibers. Saturated steam, maintained at a temperature in excess of 200° F. is used to assist fixation of the dyestuff in the fabric. Any unattached dye or any remaining process agents are removed by washing.

Preferably, the nylon 6,6 yarn has a draw ratio of about 4.6 to about 5.1 and a high degree of structural order. The aqueous dyebath is preferably containing an antimigrant maintained at a temperature from ambient up to about 150° F.

A continuously-dyed high-tenacity nylon 6,6 fabric produced by the process of this invention exhibits the following quantifiable physical characteristics, all as measured by the Kawabata Evaluation System, which is described below in Example V. They are:

(1) the Tensile Filling Extension (EM2) of the continuously-dyed nylon fabric is at least 50% greater than that of a jig-dyed fabric made from a greige fabric of the same construction; (2) the Warp and Filling Rigidities (G1 and G2) of the continuously-dyed nylon fabric are less than half those of a jig-dyed fabric made from a greige fabric of the same construction; and (3) the Warp and Filling Shear Hystereses (2HG1 and 2HG2) are less than half those of a jig-dyed fabric made from a greige fabric of the same construction.

Dyebath an aqueous dyebath suitable for use on a continuous pad system is prepared and contains several of the following ingredients: an acid dyestuff, preferably but not necessarily monosulfonic and a wetting agent serving the dual function of a wetting agent and a penetrant. Dioctylsulfosuccinic acid sodium salt is quite suited to this use. Included also is an antimigrant to prevent migration of dye on the fabric prior to fixation; sodium alginate is a preferred antimigrant, although synthetic antimigrants such as dry polyacrylic acid resins may also be useful to prevent migration.

The dyebath also includes a two-component dye transport system which is active at high temperatures and facilitates heretofore unobserved rapid penetration of the fiber in filament bundles. The dye transport system includes a retarding/leveling agent acting as a colorless dye in the earlier stages of the dyeing process, but which volatilizes at high temperatures during later stages of the processing. This component minimizes the initial rapid fixation tendency of dyes on nylon fiber surfaces, which leads to undesirable ring dyeing or poor filament bundle penetration.

The preferred retarding/leveling agent is Cenegen 7 (Crompton & Knowles) an alkaryl ether sulfonate derivative, anionic in nature and water miscible.Other retarding/leveling agents to be considered include Cenegen B (alkyl ether salts, ampholytic, water miscible), Cenegen BP (alkylaryl sulfo derivative, anionic, water miscible) and Cenekol 1141 (sulfonated phenolic condensate, anionic, water miscible) all from Crompton & Knowles Corporation; Irgalev PBF anionic alkyl diphenyl-ether derivative, (an anionic leveling agent for nylon, water dilutable) from Ciba-Geigy Corporation; Alkanol WXN (sodium alkyl benzene sulfonate, a surfactant completely miscible with water) and Alkanol ND (sodium alkyl diaryl sulfonate, a dyeing assistant) both from DuPont; and Chemcogen AC (Lyndal Chemical Company). The second component of the dye transport system is a glycol, especially diethylene glycol, which remains in the fabric even at high temperatures. Diethylene glycol (DEG) is preferred since we have found it to be more effective than the glycol ethers or other glycols, such as triethylene glycol. Other additives and adjuvants may be added to the dyebath as required.

Application the dyebath described above is applied to the high-tenacity nylon fabric using any convenient application means. We prefer to use a pad bath operating at a minimum volume level. The pad operator is able to effectively control the amount of dyebath applied to the fabric calculated as percentage of wet pick-up with a pair of squeeze or nip rolls pressing the fabric as it emerges from the pad bath. The tendency of the fabric to present differential shading from end to end, i.e., "tailing", is significantly reduced by the action of the retarder/leveler, as well as by reduced exposure times in the pad bath. Applying the dyebath in a pad permits operation within wide variations and allows the operator an added degree of flexibility in this continuous process.

Preliminary Drying the fabric emerging from the pad is at least partially dried to a level sufficient to reduce migration of the dyebath. It is at this point that the transport system, as detailed above, becomes active and, although not wishing to be bound to any particular theory, we believe the retarding/leveling agent temporarily occupies the dye sites of the outer shell filaments in the nylon bundle while the diethylene glycol assists the dye to diffuse among the inner filaments at a uniform rate. In this manner both components work together to enhance uniform penetration of the filament bundle. These procedures also improve the appearance of the total fabric through a less competitive dye-to-dyesite mechanism.

Thermofixation Treatment the fabric then passes through a conventional curing oven where thermal energy aids to further penetrate the dyes into the filaments. The dye fixation to the filaments is initiated due to the volatilization of the retarding/leveling agent and almost simultaneous adsorption of the surrounding dye. The diethylene glycol at the surface of the fibers facilitates dye transport into the fiber.

Penetration Enhancement next the fabric is rapidly immersed in a pad bath containing a penetrant/wetter and a nylon swelling agent. Suitable penetrant wetters include most dioctylsulfoccinic acid salts such as Intraphasol COP (Crompton and Knowles), Alrowet D-65 (Ciba-Geigy), Karawet DOSS (Lyndal Corporation) and others. Benzyl alcohol has been found most effective as a surface modifier/swelling agent.

Saturated Steaming fixation of the dyes in the fabric is completed by subjecting the fabric to saturated steam for short periods. Sixty seconds of exposure at 210°–220° F. has been found effective on these high-tenacity nylon fabrics. This steaming is also believed to impart a better hand, assist in further dye penetration and enhance the final appearance of the fabric.

Washing/Drying the dyed fabric is then subjected to the usual washing and drying operations as is conventional and is ready for chemical finishing operations, garment construction, etc.

As a practical matter, the degree of tenacity or robustness of the nylon fabric being treated is a limiting factor on the severity of processing conditions to which the fabric is exposed, specifically elevated temperatures and periods of time exposed to the same. Generally, the higher-tenacity fibers are able to withstand more rigorous conditions. The process is conducted on a continuous basis, as indicated, and processing speeds of 60 yards per minute may be realized.

The process of the invention is illustrated by the following in which all parts and percentages are expressed by weight unless otherwise indicated.

EXAMPLE

A full-scale trial was conducted, using the following dyebath:

1.13 g/L Tectilon Yellow 4R k250% (Acid Yellow 219)
1.59 g/L Nylomine Red A-B (Acid Red 396)
3.15 g/L Nylanthrene Blue B-GA (Acid Blue)
7.50 g/L Intraphasol CO
20.00 g/L Benzyl alcohol
20.00 g/L Cenegen 7
20.00 g/L Diethylene glycol
30.00 g/L Unipad B antimigrant The bath was padded onto Cordura ® 440, 1000/140, air-textured nylon plain weave fabric, weighing 8.5 oz/sq.yd., at approximately 35% wet pickup (OWF). The dye bath was maintained at 130° F. Following padding, the fabric was dried by means of infrared preheating to minimize dye migration, followed by oven drying and steam can contact drying. Thermofixation was carried out in a conventional curing oven at a setting of 420° F. for 2.15 minutes.

The fabric was subsequently immersed in a chempad maintained at 160° F., containing 7.5 g/L of Intraphasol COP and 20.0 g/L of benzyl alcohol. The fabric was then squeezed to a wet pickup of 32–35% (OWF), and passed into a saturated steamer operating at 220°–224° F. for 60 seconds. The fabric then exited into a series of eight wash boxes, double laced. Wash boxes Nos. 1 and 2, which served for scouring, contained 4.0 g/L of a nonionic detergent and 5.0 g/L of sodium bicarbonate.

Wash boxes Nos. 3 through 8 served as final rinses at 180° F. before steam can drying at 30 psig steam pressure.

The dyed fabric exhibited a high degree of uniformity of color from the beginning to the end of the run.

EXAMPLE II

A full-scale trial was conducted, using the following dyebath:

1.20 g/L Tectilon Yellow 4R k 250% (Acid Yellow 219)
3.80 g/L Nylomine Red A-B (Acid Red 396)
1.68 g/L Nylanthrene Blue B-GA (Acid Blue)
7.50 g/L Intraphasol COP
20.00 g/L Benzyl alcohol
20.00 g/L Diethylene glycol
30.00 g/L Cenegen 7
30.00 g/L Unipad B antimigrant The bath was padded onto Cordura® 440, 1000/140 nylon fabric, weighing 8.5 oz./sq.yd., at approximately 35% wet pickup (OWF). The dyebath was maintained at 130° F., and the fabric speed was 60 ppm. Following padding, the fabric was dried by infrared preheating to minimize dye migration, followed by oven drying at 300° F. and steam can contact drying at 30 psig. Thermofixation was carried out in a conventional hot air curing oven at 420° F. for at least 90 seconds, and preferably for 135 seconds.

Upon exiting the curing oven, the fabric was cooled on cooling cans filled with cold water, and then immersed in a chemical pad maintained at 160° F., containing 7.5 g/L of Intraphasol COP and 20 g/L of benzyl alcohol. The fabric was then squeezed to a wet pickup of approximately 32% OWF, and passed into a saturated steamer for 60 seconds at 220°–224° F. The fabric then exited into a series of eight wash boxes, double laced. Wash boxes Nos. 1 and 2, which served for scouring at 120° F., contained 4 g/L of NID, a nonionic detergent, and 5 g/L of sodium bicarbonate. Wash boxes Nos. 3 through 8 served as final rinses at 180° F. before steam can drying at 30 psig.

The dyed Cordura® fabric exhibited a highly uniform khaki shade.

EXAMPLE II

A full-scale trial was conducted as described in Example II, using an air-textured, high tenacity nylon duck fabric weighing 5.93 oz./sq.yd., and made of 420/68 nylon. In this trial, the wet pickups were approximately 30%, and the dyebath had the following composition:

9.50 g/L Nylomine Blue A-G conc. (Acid Blue 25, C.I. No. 62055)
7.20 g/L Nylanthrene Blue B-GA (Acid Blue)
7.50 g/L Intraphasol COP
20.00 g/L Benzyl alcohol
20.00 g/L Diethylene glycol
30.00 g/L Cenegen 7
30.00 g/L Unipad B antimigrant The dyed nylon duck fabric exhibited a highly uniform "Royal Blue" shade.

EXAMPLE IV

A sample of air-textured 1000/140 Cordura® 440 nylon plain-weave fabric (8.5 oz/sq.yd.), dyed to an olive green shade as described in Example I, was compared for uniformity of color with a commercial olive green sample greige fabric of the same weight and construction. The latter fabric had been jig dyed by Kenyon Piece Dye Works by conventional, commercial processing, and is representative of the current state of the art. Table 1 shows the results of measurements of uniformity of color of the commercial fabric, and Table 2 gives corresponding data for a fabric dyed by the process of the present invention.

Tables 1 and 2 present data for the range of lightness (L) and depth of shade (KSSUM Value) for the two fabrics. Since the fabrics were similar in color and no significant shifts in hue exist, the KSSUM and L values are adequate for describing uniformity of color. Examination of Tables 1 and 2 shows that the range of color variation is substantially greater in the commercially available jig-dyed fabric. The numbers confirm the differences in appearance of the dyed fabric.

TABLE 1

Uniformity of Color of Commercial Jig Dyed Cordura- Fabric

| Specimen No. | Lightness | KSSUM Value |
|---|---|---|
| 1 | Standard | 24.5 |
| 2 | 0.81 Heavy | 25.9 |
| 3 | 0.45 Light | 23.7 |
| 4 | 0.16 Heavy | 24.9 |
| 5 | 0.93 Heavy | 26.3 |
| 6 | 1.10 Heavy | 26.5 |
| 7 | 0.52 Light | 25.3 |
| 8 | 0.12 Heavy | 25.0 |
| 9 | 0.37 Heavy | 25.3 |
| 10 | 0.93 Light | 23.1 |
| | Range: 2.03 | Range: 2.4 |

TABLE 2

Uniformity of Color of Continuously-Dyed Cordura- Fabric

| Specimen No. | Lightness | KSSUM Value |
|---|---|---|
| 1 | Standard | 21.6 |
| 2 | 0.12 Light | 21.4 |
| 3 | .00 | 21.5 |
| 4 | .14 Light | 21.4 |
| 5 | .10 Heavy | 21.8 |
| 6 | .01 | 21.6 |
| 7 | .12 Heavy | 21.7 |
| 8 | .02 | 21.5 |
| 9 | .32 Heavy | 22.0 |
| 10 | .02 | 21.4 |
| | Range: 0.46 | Range: 0.6 |

In Table 1, the mean KSSUM value for the 10 specimens was 25.1; the standard deviation was 1.08. For Table 2, the mean KSSUM value was 21.6 and the standard deviation 0.197. The range and the standard deviation are statistical measures of variability. A low range or a low standard deviation signifies low variability, or high uniformity. Thus, the low range and standard deviation of the color from place to place of the fabric dyed by the process of this invention (Table 2) show its superior uniformity of color as compared with the jig-dyed fabric (Table 1). These data provide quantitative measures of the superior uniformity seen by the eye.

EXAMPLE V

The same two fabrics that were examined in Example 4 were analyzed for differences in hand and mechanical properties, and compared with the greige fabric control. Subjective evaluation showed that the fabric dyed by the process of this invention felt thinner, smoother, more flexible and livelier than the commercially available fabric. The subjective evaluation was confirmed by measurements made on the Kawabata Evaluation System (KES), which is described in detail in the book "The Standardization and Analysis of Hand Evaluation", Second Edition, by S. Kawabata, The Textile Machinery Society of Japan, July 1980.

The Kawabata Evaluation System was developed by Dr. Sueo kawabata to permit the objective, quantitative evaluation of the hand of fabrics, much as spectrophotometer permits the objective measurements of the color of a textile. The System is described in layman's terms in a paper published by F. Fortess et al in Bobbin, October 1982, pp. 32–36. The System is now used commercially to specify hand in Japan, Australia and some parts of Europe.

The Kawabata Evaluation System employs a set of precise, sensitive testing instruments, developed by Dr. Kawabata. These instruments are capable of measuring the mechanical properties of even lightweight apparel fabrics at low levels of extension, compression, or shearing, as well as the thickness, surface smoothness and coefficient of friction of textile surfaces. The ability of fabrics to recover from distortion, or their hysteresis, can also be measured. The specific properties and ranges of distortion have been chosen to correlate with the distortions produced in handling a fabric. Close correlations have in fact been demonstrated between expert subjective judgements of fabric hand and the objective measurements obtained by the Kawabata Evaluation System.

In the data which are presented herein, the following terms of the Kawabata System are used; their meanings are listed below. In the tensile measurements, strips of fabric 5 cm×20 cm were loaded to 500 g/cm in the long direction of the strip.

Tensile Strength

EM1 is the extension of a strip of fabric in the warp direction when the tensile force equals 500 g/cm of width.

EM2 is the extension of a strip of fabric in the filling direction when the tensile force equals 500 g/cm of width.

LT1 is a measure of the linearity of the load-extension curve in the warp direction.

LT2 is a measure of the linearity of the load-extension curve in the filling direction.

WT1 represents the amount of work required to stretch the fabric in the warp direction.

WT2 represents the amount of work required to stretch the fabric in the filling direction.

RT1 represents the percent of work recovered when a warp strip is loaded and unloaded.

R2 represents the percent of work recovered when a filling strip is loaded and unloaded.

Shearing Properties

G1 represents the shearing stiffness when a 5 cm×20 cm warp strip is sheared in a plane. Its units are g/cm.degree.

G2 represents the shearing stiffness when a 5 cm×20 cm filling strip is sheared in a plane.

2HG1 represents the hysteresis in warp shearing force (or difference in force between the deformation curve and the relaxation curve) when the shearing angle is 0.5 degree, a small deformation.

2HG2 represents the corresponding data for a filling strip.

2HG51 represents the hysteresis in warp shearing force when the shearing angle is 5 degrees, a larger deformation.

2HG52 represents the corresponding data for a filling strip.

Compressional Properties

LC represents a measure of the linearity of the compression curve when 2 $cm^2$ of fabric are compressed to a pressure of 50 $g/cm^2$

WC represents the amount of work required to compress the fabric to a load of 50 $g/cm^2$. The units are $g.cm/cm^2$.

RC represents the resilience or the percent of work recovered when the fabric is loaded and unloaded in compression.

TO is the thickness of the specimen (in cm) when it is loaded to a pressure of 0.5 $g/cm^2$.

TM is the corresponding thickness at a load of 50 $g/cm^2$

Surface Properties

MIU1 is the coefficient of friction in the warp direction.

MIU2 is the coefficient of friction in the filling direction.

MMD1 is the mean deviation of MIU1.

MMD2 is the mean diviation of MIU2.

SMD1 is the geometrical roughness of a strip of fabric in the warp direction.

SMD2 is the geometrical roughness of a strip of fabric in the filling direction.

Further details of the instruments and methods are presented in the publication of Dr. Kawabata cited above.

The results of the Kawabata measurements are presented in Table 3. Significant differences are marked with an asterisk.

TABLE 3

Results of Measurements Made on the Kawabata Evaluation System; Comparison of Fabric Dyed Continuously vs. Jig-Dyed Fabric

| | This Process** | Jig Dyed | Greige Fabric |
|---|---|---|---|
| Tensile | | | |
| Warp extension (EM1) | 2.13 | 2.15 | 2.33 |
| Fill extension (EM2) | 4.53 | 2.75* | 3.21 |
| Warp linearity (LT1) | .734 | .793 | .663 |
| Fill linearity (LT2) | .702 | .785 | .704 |
| Warp work (WT1) | 3.88 | 4.25 | 3.86 |
| Fill Work (WT2) | 7.90 | 5.33 | 5.65 |
| Warp Recovery (RT1) | 56.95 | 58.85 | 63.4 |
| Fill Recovery (RT2) | 51.48 | 52.13 | 56.0 |
| Shear | | | |
| Warp rigidity (G1) | 3.48 | 9.11* | 9.24 |
| Fill rigidity (G2) | 3.61 | 10.60* | 9.85 |
| Warp hysteresis @ .5 (2HG1) | 3.38 | 14.45* | 18.58 |
| Fill hysteresis @ .5 (2HG2) | 3.01 | 13.05* | 14.78 |
| Warp hysteresis @ 5 (2HG51) | 20.69 | 38.51* | 41.60 |
| Fill hysteresis @ 5 (2HG52) | 22.76 | 46.36* | 45.67 |
| Compression | | | |
| Linearity (LC) | .329 | .392 | .543 |
| Work (WC) | .110 | .117 | .1026 |
| Recovery (RC) | 51.6 | 53.4 | 58.0 |
| Thickness @ .5 g/sq. cm. (TO) | .656 | .709* | .631 |
| Thickness @ 50 g/sq./cm. (TM) | .521 | .587* | .555 |
| Surface | | | |
| Warp coef. of friction (MIU1) | .1762 | .1972 | .183 |
| Fill coef. of friction (MIU2) | .1847 | .2247 | .241 |
| Warp dev. friction coef. (MMD1) | .0355 | .0461* | .0334 |
| Fill dev. friction coef. (MMD2) | .0449 | .0492* | .0491 |
| Warp surface roughness (SMD1) | 15.86 | 19.60* | 15.40 |
| Fill surface roughness (SMD2) | 10.96 | 11.54* | 7.31 |

*Significant property differences.
**Continuously dyed by the process of this invention.

A summary of the significant differences is presented below.

Tensile Properties

Fabric dyed by the present process had greater extension in the filling direction than either the jig-dyed fabric or the control.

Shear Properties

Fabric dyed by the present process had lower rigidities and hysteresis than the jig-dyed counterpart or the greige control; therefore, continuously-dyed fabric is more flexible and livelier.

Bending Properties

Fabrics were too stiff for the bending tester; therefore, no bending results were obtained.

Compression Properties

Fabric dyed by the present process had lower thickness at both 0.5 gf/sq.cm. and the 50 gf/sq.cm. than did jig-dyed fabric or the greige control.

Surface Properties

Fabric dyed by the present process had lower warp coefficient of friction MIU1) and lower deviation of the warp coefficient of friction (MMD1) than the jig-dyed fabric. Therefore, the fabric dyed by the present process was smoother and slicker in the warp direction. There were no significant differences in the filling direction.

The fabric dyed by the present process had greater flexibility and liveliness plus a flatter, smoother surface.

What is claimed is:

1. A continuous process for uniformly dyeing high-tenacity industrial nylon fabrics composed of high tensile strength nylon 6,6 yarn having a draw ratio of at least 4.0 to about 5.1 comprising the successive steps of:

(1) applying to the nylon fabric in open width an aqueous dyebath volatile at elevated temperatures containing a tinctorial amount of an acid dyestuff, a wetting agent and a dye transport system active at elevated temperatures and composed of (a) a retarding and leveling agent to facilitate rapid penetration of the nylon filament bundles and (b) a mono, di- or tri- lower ($C_1$–$C_4$) alkylene glycol having a molecular weight in the range of about 50 to about 200;

(2) drying the dyed fabric of step (1) to reduce migration of the dyebath liquid on the fiber, to heat activate the dye transport system and promote uniform penetration of the filament bundle;

(3) thermofixing the treated fabric of step (2) at elevated temperatures in the range of about 375° to about 425° F. to penetrate the dyestuff into the fibers and to volatilize the aqueous dyebath then (4) enhancing dye penetration by exposing the fabric to a wetting agent and a nylon swelling agent, to swell the nylon fibers and further penetrate the dyestuff into the nylon fibers;

(5) subjecting the fabric to saturated steam maintained at a temperature in excess of 200° F. for a period of time sufficient to completely fix the dyestuff in the fabric; and thereafter (6) washing the fabric to remove any unattached dye and any remaining processing agents.

2. The process of claim 1 in which the nylon 6,6 yarn has a draw ratio of about 4.6 to about 5.1.

3. The process of claim 1 in which the aqueous dyebath is applied to the fabric in open width in a pad bath.

4. The process of claim 3 in which the aqueous dyebath is maintained at a temperature from ambient up to about 150° F.

5. The process of claim 4 in which the aqueous dyebath also includes an antimigrant.

6. The process of claim 4 in which the dye is a monosulfonic acid dye.

7. The process of claim 1 in which the fabric is dried in step (2) by infrared heaters.

8. The process of claim 1 in which the wetting agent of step (4) is a dioctylsulfosuccinic acid salt.

9. The process of claim 1 in which the fabric is thermofixed in step (3) for a period of from about 0.5 to about 3 minutes.

10. The process of claim 1 in which the fabric is steamed in step (5) at a temperature of about 210° F. to about 220° F. for a period of from about 30 to about 120 seconds.

11. The process of claim 1 in which the nylon swelling agent of step (4) is applied at a temperature of from 150° F. to about 175° F.

12. A continuously-dyed, high-tenacity nylon 6,6 fabric, the Tensile Filling Extension (EM2) of which, as measured by the Kawabata Evaluation System, is at least 50% greater than that of a jig-dyed fabric made from a greige fabric of the same construction.

13. A continuously-dyed, high-tenacity nylon 6,6 fabric, the Warp and Filling Rigidities (G1 and G2) of which, as measured by the Kawabata Evaluation System, are less than half of those of a jig-dyed fabric made from a greige fabric of the same construction.

14. A continuously-dyed, high-tenacity nylon 6,6 fabric, the Warp and Filling Shear Hystereses (2HG1 and 2HG2) of which, as measured by the Kawabata Evaluation System, are less than half those of a jig-dyed fabric made from a greige fabric of the same construction.

* * * * *